US005730470A

United States Patent [19]

Papritz

[11] Patent Number: 5,730,470

[45] Date of Patent: Mar. 24, 1998

[54] QUALITY DATA COLLECTION IN ROTARY OFFSET PRINTING OF SINGLE EDITIONS

[75] Inventor: Stephan Papritz, Rubingen, Switzerland

[73] Assignee: Maschinenfabrik Wifag, Bern, Switzerland

[21] Appl. No.: 380,361

[22] Filed: Jan. 30, 1995

[30] Foreign Application Priority Data

Jan. 31, 1994 [DE] Germany ..... 44 02 784.2

[51] Int. Cl.[6] ..... B42D 15/00

[52] U.S. Cl. ..... 283/114; 283/93

[58] Field of Search ..... 283/93, 114, 902, 283/901, 117, 91

[56] References Cited

U.S. PATENT DOCUMENTS

| | | | |
|---|---|---|---|
| 4,310,248 | 1/1982 | Meredith . | |
| 4,659,113 | 4/1987 | Muller et al. | 283/901 X |
| 4,932,685 | 6/1990 | Mancuso | 283/91 |
| 4,967,379 | 10/1990 | Ott | 364/526 |
| 4,968,064 | 11/1990 | Mancuso | 283/91 |
| 4,972,329 | 11/1990 | Breger | 283/81 X |
| 5,068,810 | 11/1991 | Ott | 364/526 |
| 5,205,211 | 4/1993 | Edwards | 283/117 X |
| 5,206,707 | 4/1993 | Ott | 356/402 |
| 5,224,421 | 7/1993 | Doherty | 101/211 |
| 5,227,871 | 7/1993 | Fundada et al. | 283/902 X |
| 5,602,970 | 2/1997 | Janser | 395/109 |

FOREIGN PATENT DOCUMENTS

| | | |
|---|---|---|
| 0 196 431 A3 | 2/1986 | European Pat. Off. . |
| 0196431B1 | 2/1986 | European Pat. Off. . |
| 0 321 402 A1 | 12/1988 | European Pat. Off. . |
| 0321402A1 | 6/1989 | European Pat. Off. . |
| 0 421 003 A1 | 10/1989 | European Pat. Off. . |
| 0 408 507 A1 | 7/1990 | European Pat. Off. . |
| 0408507A1 | 1/1991 | European Pat. Off. . |
| 0 505 323 A1 | 3/1992 | European Pat. Off. . |
| 36 26 423 A1 | 2/1988 | Germany . |
| 36 43 721 A1 | 6/1988 | Germany . |
| 39 03 981 A1 | 8/1990 | Germany . |
| 4209165A1 | 9/1992 | Germany . |

OTHER PUBLICATIONS

Von Ing. Wolfgang Walenski 1995 *Testformen und Druckkontrollstreife n* Offsetpraxis Druckmamgazin, Dokumentation.

Dr. Michael Has Nov. 1993 *Farbe total ProfiPublisher.*

*Primary Examiner*—Frances Han

*Attorney, Agent, or Firm*—McGlew and Tuttle

[57] ABSTRACT

A group of measured fields (as well as a process for providing them and using them) is provided for determining color data of a printed product, especially for collecting quality data in the rotary offset printing of single editions, with a plurality of measured fields, which are printed on a printed product to be checked or on a primary print in such a way that they can be optically scanned, the group of measured fields includes a superprinted, at their nominal degrees of surface coverage ($F_{c1}$, $F_{m1}$, $F_{y1}$), first combination measured field (1), including the fundamental colors, especially the three colors cyan, magenta and yellow, and printed additional single-color half-tone fields, in the fundamental colors, wherein the single-color half-tone fields have, in their corresponding fundamental color, a degree of surface coverage $F_{c1}$, $F_{m1}$, $F_{y1}$ that corresponds to that of the same color in the first combination measured field (1).

4 Claims, 1 Drawing Sheet

QUALITY DATA COLLECTION IN ROTARY OFFSET PRINTING OF SINGLE EDITIONS

FIELD OF THE INVENTION

The basic idea of color management is that colored originals are determined in the digital preliminary stage of printing independently from output devices and materials. The colors are consequently described in a colorimetric system of coordinates standardized by the Commission Internationale de l'Eclairage (CIE), such as XYZ, CIELAB or CIELUV. If multicolor images thus defined are output on paper via a system calibrated in terms of color management, it is guaranteed that the appearance of the output as regards color will always be the same, completely independently from the output process used.

BACKGROUND OF THE INVENTION

Among other things, computer color printers, digital color copiers and digital proofing devices are currently used as output systems that can be calibrated. It is desirable to expand the concept of color management to conventional printing processes, such as newspaper offset, as well. The chain of actions consisting of the printing form preparation and the printing process is treated now as any other output device that can be calibrated. However, before this is achieved, it is still necessary to create the prerequisites for

- the systematic determination of the appearance of multicolor images as regards color in the offset printing of single editions of newspapers,
- the suppression or elimination of accidental deviations, and
- the compensations for systematic deviations.

Numerous solutions to the monitoring and the control of inking in multicolor offset printing have currently been known.

For example, EP 0 196 431 B1 discloses a process and a device for achieving a uniform printing result on an autotypically operating multicolor offset printing press. This solution is characterized by the measurement of ink layer thicknesses (full- tone densities) and half-tone dot sizes (degrees of surface coverage) on measured fields, which are printed jointly for each printing ink in each ink-setting zone of the printing press. The color-guiding final control elements on the printing press are automatically adjusted based on these densitometric measured values.

The necessity to jointly print a plurality of measured fields in each ink-setting zone has led to the above-mentioned process having been used to date exclusively for jobbing offset printing, because in jobbing rotary printing, the measured fields can be printed outside the printing area, i.e., on a margin, which is cut off at the end. This prerequisite is not met in newspaper offset. No margin is cut off here, and any measured field printed must be accommodated within the printing area, thus requiring space, which could otherwise be used for advertisements or editorial reports. Newspaper publishers are therefore reluctant to accept measured fields.

The high expense of equipment and the high labor cost, which is due to the measurement of the measured fields, can be considered to be another obstacle to the use of the above process in newspaper offset. If the measurement is to be performed in the rotary offset process on-line, i.e., automatically on the running web, an optical measuring head with automatic positioning is necessary for each side of the web. If the measurements were performed, instead, with commercially available manual densitometers or manual spectrophotometers, it would be necessary to use additional personnel specifically for the purpose of quality data collection in view of the great number of measured fields and the time required for the manual positioning of the measuring instrument. A systematically performed quality data collection cannot become successful in the offset printing of single editions of newspapers as long as it is associated with a high investment or a high additional manpower requirement.

The process described in EP 0 196 431 B1 has another disadvantageous property, because characteristics which are not directly related to the appearance of the printed product as regards color are measured with the full-tone and half-tone densities of the individual inks. This shortcoming can be eliminated by also providing and colorimetrically measuring so-called combination measured fields, i.e., measuring fields in which the fundamental colors involved in the printing are printed over each other in a half tone.

Colorimetric measured values thus obtained can be related to the XYZ color space based on the sensitivity function of the average human eye, or to the perceptionally equidistant CIELUV or CIELAB color spaces derived from the XYZ system, which were all standardized by the CIE (Commission Internationale de l'Eclairage).

The colorimetric measurement on combination measured fields offers the advantage that it provides information on the interaction of all the colors involved in a multicolor printing. The colorimetric measured values immediately provide information on the appearance of the combination measured field or the printed product as regards color for the human observer. Another advantage is the fact that the combination measured fields can possibly be replaced with image areas with a suitable image structure. In contrast to densitometric methods, the colorimetric measurement methods have the disadvantage of not providing any direct information for process control. For example, it is not possible to infer from a deviation of the color location how the color guiding on the printing press must be corrected to reduce the deviation.

Methods were developed, with which deviations in the color location can be converted into variations of the layer thicknesses or of the densities of the individual colors involved in printing. Thus, EP 0 321 402 A1 and EP 0 408 507 A1 disclose linear transformations for converting variations of the full-tone or half-tone densities into variations of the color location of combination measured fields in the CIELUV or CIELAB color spaces.

These transformations make it possible, e.g., to calculate the change in the full-tone densities of single-color measured field, which change is necessary to compensate the deviation of the color location in the combination measured field, from a deviation of the color location of a combination measured field on a proof sheet. Consequently, the strategy followed is to correct undesired deviations of the color location of combination measured fields exclusively by making suitable changes in the ink layer thicknesses of the colors involved in the printing process.

The limitation to changes in the ink layer thicknesses in EP 0 408 507 A1 appears to be somewhat arbitrary, because the correction of color location deviations can also be achieved, in principle, by appropriately changing the degrees of surface coverage of the individual printing inks. This can happen, e.g., in the digital preliminary stage of printing, when the color separations are examined. This possibility is particularly interesting when an essential portion of the color location deviations observed for a certain combination measured field is symmetrical, i.e., not exclusively accidental. Another advantage is the fact that a change in the degrees of surface coverage of the printing inks is often easier to manage during the calculation of the color separations than a change in the ink layer thicknesses used on the printing press. The idea of taking into account individual printing characteristics of individual inking mechanisms in the calculation of the color separations has been known from DE 42 09 165 A1. However, no relation is established there to colorimetric measured values on combination measured fields or image areas. It follows from the above explanations that the quality data collection and process optimization methods that are currently known and are intended predominantly for the jobbing offset printing of single editions cannot be extrapolated without any changes to the newspaper offset printing of single editions. This explains why it is still a common practice now in newspaper offset printing to leave the monitoring and the control of inking to the rather untrained, but definitely subjective eye of the printer.

SUMMARY AND OBJECTS OF THE INVENTION

An improvement in the objective methods discussed above is desirable, especially based on the following insight, for use in the offset printing of single editions of newspapers:

- The necessary number of measured fields should be reduced in order for the measured fields to occupy less space in the printing area of the newspaper.
- The expense of equipment and the labor cost for measuring the measured fields shall be reduced.
- The methods shall be based on a statistical check in the future. Measured fields will then be printed only in a few representative color zones, and the results will be extrapolated to the entire printing process. This complies with both above-described requirements.
- The measurement on image areas with a suitable image structure shall make the joint printing and measurement of special measured fields unnecessary to the extent possible.
- Both colorimetric and densitometric measured values should result from the same measurement. As a result, information on the appearance of the printed product as regards color and on the possibilities of correcting it in both the preliminary stage of printing and at the printing press can be derived at the same time.

The primary object of the present invention is to provide measured fields for color data collection for a printed product, which are suitable for quality data collection in the rotary offset printing of single editions as well, especially for the statistical quality data collection, and whose use in such a quality data collection process makes it possible to use especially a process which meets a few, several and preferably all the above-described requirements. The process and the measured fields developed for it shall also be able to be used in the offset printing of single editions of newspapers.

According to the invention, a group of measured fields (as well as a process for using them and for providing them) is provided for determining color data of a printed product, especially for collecting quality data in the rotary offset printing of single editions, with a plurality of measured fields, which are printed on a printed product to be checked or on a primary print in such a way that they can be optically scanned, the group of measured fields comprises:

a) a superprinted, at their nominal degrees of surface coverage ($F_{c1}$, $F_{m1}$, $F_{y1}$), first combination measured field (1), including the fundamental colors, especially the three colors cyan, magenta and yellow, are, and b) printed additional single-color half-tone fields, in the fundamental colors, wherein the single-color half-tone fields have, in their corresponding fundamental color, a degree of surface coverage $F_{c1}$, $F_{m1}$, $F_{y1}$ that corresponds to that of the same color in the first combination measured field (1).

Additionally, a) the measured field group preferably contains additional combination measured fields, in which the fundamental colors are superprinted at varied nominal degrees of surface coverage ($F_{c2}=F_{c1}+\Delta F_{c2}$, $F_{m1}$, $F_{y1}$), ($F_{c1}$, $F_{m3}=F_{m1}+\Delta F_{m3}$, $F_{y1}$) and ($F_{c1}$, $F_{m1}$, $F_{y4}=F_{y1}+\Delta F_{y4}$), and each fundamental color is varied at least once, and at least one other fundamental color is varied in each additional combination measured field, and b) the group of measured fields has additional single-color half-tone fields, in which the fundamental colors have a degree of surface coverage of $F_{c2}$, $F_{m3}$, $F_{y4}$, which corresponds to the varied degree of surface coverage of the same color in the additional combination measured fields.

The process for collecting quality data, especially for collecting statistical quality data in the rotary offset printing of single editions, preferably comprises:

a) jointly printing measured fields and/or image areas used as measured fields;

b) optically scanning the optical fields after the printing process;

c) evaluating the remitted light; and d) using a group of measured fields as noted above.

Even though the solution is especially advantageous for the special requirements of newspaper printing, this does not at all rule out a profitable application in other areas, such as rotary jobbing offset printing.

The process according to the present invention is based on the following considerations:

- For a given paper and ink material, the appearance of a surface printed by multicolor superprinting as regards color is determined by the interaction of the ink layer thickness and the effective degree of surface coverage of all printing inks located one on top of another.
- The combined effect of the printing inks involved is determined by a single optical scanning by colorimetric measurement on a combination measured field, i.e., on a measured field in which a plurality of inks in half tones or full tones are printed one over the other.
- The contribution of the individual ink can be best characterized by its layer thickness and by the half-tone dot size. The densitometric equivalent for this is the full-tone density and the effective degree of surface coverage in the print. These two parameters are measured in conventional test methods per printing ink involved by density measurement on a single-color control field in full tone and half tone each. The degree of surface coverage is usually calculated according to the well-known Murray-Davies formula.
- If the quality data collection in the offset printing of single editions is based exclusively on densitometric measurements, at least two single-color measured fields must consequently be printed as well. These measured fields are to be individually subjected to a density measurement. If information on the interaction of the ink layers is additionally required as well, additional densitometric measurements must be performed on additional two-color or three-color combination measured fields to determine the ink absorption. In three-color superprinting, this leads, e.g., to at least 10 optical scannings.

The expense is reduced if the half-tone density of a color is considered instead of the full-tone density and of the degree of surface coverage of the color in question. The half-tone density describes the combined effect of the other two influence variables. However, a differentiated investigation of the causes of variations is more difficult now.

There is a natural relationship between the colorimetric values determined on a combination measured field, on the one hand, and the densitometric parameter, namely, the half-tone density of the individual inks, on the other hand. This relationship is generally complicated.

However, it can be simplified if only variations of the variables of interest around a defined working point are considered, which is usually sufficient in printing practice in light of the corresponding standardization efforts.

The following procedure is proposed:

The systematic relationship between the variations of colorimetric parameters on combination measured fields and variations of the half-tone density of the individual inks is determined empirically on primary prints for a given paper, a given ink material, a defined printing press, and a given working point. The working point is advantageously characterized by the nominal degrees of surface coverage of the individual inks in the combination measured field, i.e., the degrees of surface coverage of the combination measured field on the film originals or on the printing plates.

The result of the evaluation of the primary prints thus forms a transformation function, per working point, which converts variations of the half-tone density in the single-color half-tone fields into variations of the color location vector of the combination measured field and vice versa.

Only the combination measured field is thus printed and measured colorimetrically on the printed product to be checked for its appearance as regards color. The color location deviation or color location variation is calculated from this measured actual color location by subtracting a predetermined desired color location.

The variations of the half-tone density of the individual colors are now calculated from the variations of the color location vector of the combination measured field by reversing the transformation function found.

Measured fields or image areas used as measured fields are jointly printed for quality data collection, especially for statistical quality data collection, and they are optically scanned after printing. The remitted light is evaluated.

According to the present invention, the printed product to be checked and one or more primary prints have a first combination measured field each, in which the fundamental colors, usually the three colors cyan, magenta and yellow, are superprinted at the nominal degrees of surface coverage ($F_{c1}$, $F_{m1}$, $F_{y1}$).

The primary print or primary prints additionally have combination measured fields, in which the fundamental colors at the nominal degrees of surface coverage ($F_{c2}=F_{c1}+\Delta F_{c2}$, $F_{m1}$, $F_{y1}$), ($F_{c1}$, $F_{m3}=F_{m1}+\Delta F_{m3}$, $F_{y1}$, ($F_{c1}$, $F_{m1}$, $F_{y4}=F_{y1}+\Delta F_{y4}$) are superprinted. In each of these additional combination measured fields, at least one fundamental color is varied, i.e., the first fundamental color is varied by the value $\Delta F_{c2}$ in the second field, the second fundamental color is varied by the value $\Delta F_{m3}$ in the third field, and the third fundamental color is varied by the value $\Delta F_{y4}$ in the fourth field. The number of additional combination measured fields and the number of colors per combination measured field preferably correspond to the number of fundamental colors. The primary prints additionally have, per fundamental color, at least two single-color half-dot fields in the fundamental colors, and each one has, in its corresponding color, a degree of surface coverage that corresponds to that of the same color in the first combination measured field. The degree of surface coverage of the other single-color half-tone field corresponds to the varied degree of surface coverage of the corresponding additional combination measured field. Thus, in the above nomenclature, the single-color half-tone fields have the degrees of surface coverage of $F_{c1}$, $F_{c2}$, $F_{m1}$, $F_{m3}$, $F_{y1}$ and $F_{y4}$. The primary print or primary prints may be printed separately or even in the printed product.

The color location vectors $\underline{R}_1$, $\underline{R}_2$, $\underline{R}_3$ and $\underline{R}_4$ can be advantageously determined in a selected colorimetric system of coordinates on these primary prints by measurement with a colorimeter on the combination measured fields. The corresponding half-tone density values $D_{c1}$, $D_{c2}$, $D_{m1}$, $D_{m3}$, $D_{y1}$ and $D_{y4}$ can be determined in the single-color half-tone fields by densitometric measurement with a filter characteristic corresponding to the individual field.

The color location vectors and the half-tone density values of one or more primary prints are used according to the present invention to determine a transformation function L, which converts a variation $$\Delta D_1 \begin{bmatrix} \Delta D_{c1} \\ \Delta D_{a1} \\ \Delta D_{y1} \end{bmatrix}$$

of the half-tone densities in the single-color half-tone fields at the nominal degrees of surface coverage $F_{c1}$, $F_{m1}$, $F_{y1}$ into variations of the color location vector $\underline{\Delta R}$ of the first combination measured field at the nominal degrees of surface coverage $F_{c1}$, $F_{m1}$, $F_{y1}$.

According to the present invention, the color location vector $\underline{R}_{11}$ should again be determined in the selected system of coordinates on the printed product to be checked by measurement with a colorimeter on the first combination measured field.

Finally, the deviation of the color location vector $\underline{\Delta R}_{11}=\underline{R}_{11}-\underline{R}_0$ determined on the printed product, which is related to a predetermined desired color location vector $\underline{R}_0$, can be converted into a variation $$\Delta D_{11} \begin{bmatrix} \Delta D_{c11} \\ \Delta D_{a11} \\ \Delta D_{y11} \end{bmatrix}$$

of the half-tone densities in existing or imaginary single-color half-tone fields at the nominal degrees of surface coverage $F_{c1}$, $F_{m1}$, $F_{y1}$ by reversing the function L.

The present invention can be advantageously used in the rotary offset printing of single editions.

A group of measured fields for determining color data of a printed product, especially for quality data collection in the rotary printing of single editions, has a plurality of measured fields, which are printed on a printed product or a primary print to be checked in such a manner that they can be optically scanned.

According to the present invention, this group of measured fields includes a first combination measured field, in which the fundamental colors are superprinted at their nominal degrees of surface coverage; additional combination measured fields, in which the fundamental colors are superprinted at varied nominal degrees of surface coverage, wherein each fundamental color is varied at least once and at least one other fundamental color is varied in each additional combination measured field; as well as additional single-color half-tone fields in the fundamental colors, wherein first individual half-tone color fields in their corresponding fundamental color have a degree of surface coverage that corresponds to that of the same color in the first combination measured field, and second individual half-tone color fields in their corresponding fundamental color have a degree of surface coverage that corresponds to that of the varied degree of surface coverage of the same color in the additional combination measured field.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

Figure 1:
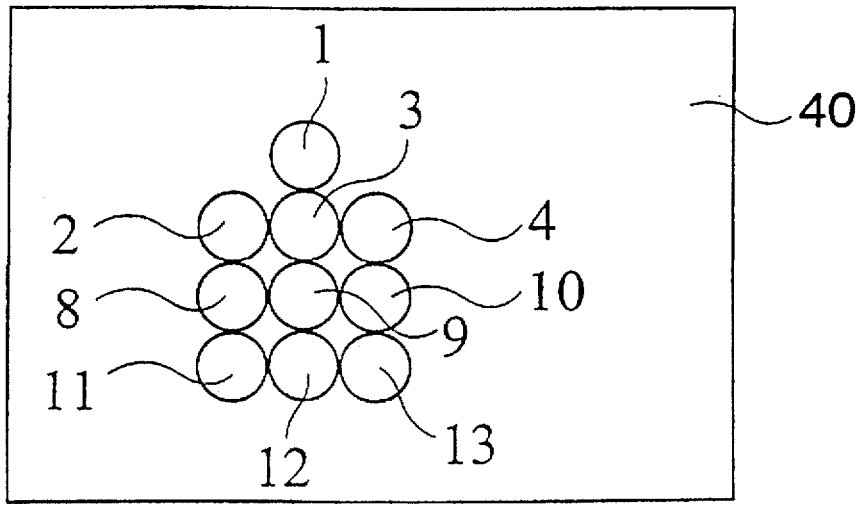
FIG. 1 is a schematic view of a primary print with measured fields and a printed product with combination measured field.
Figure 1:
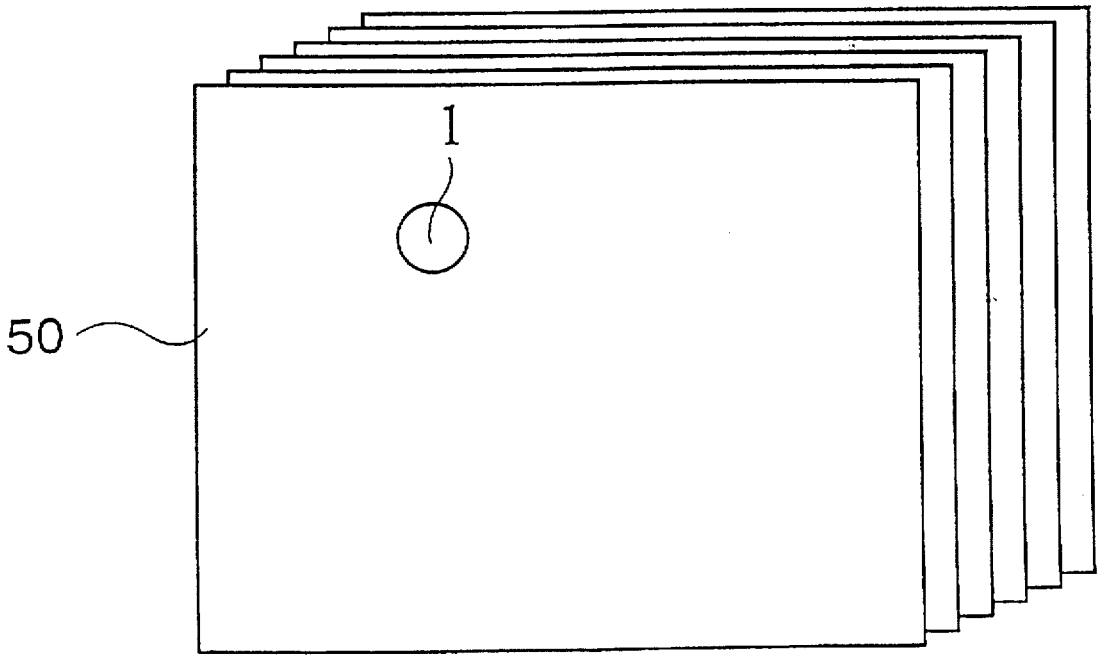

A primary print 40 contains a measured field block consisting of 10 measured fields:

The fundamental colors cyan, magenta and yellow are superprinted at the nominal degrees of surface coverage ($F_{c1}$, $F_{m1}$, $F_{y1}$) in a first three-color combination measured field 1. The fundamental colors cyan, magenta and yellow are also superprinted at the nominal degrees of surface coverage ($F_{c2}=F_{c1}+\Delta F_{c2}$, $F_{m1}$, $F_{y1}$), ($F_{c1}$, $F_{m3}=F_{m1}+\Delta F_{m3}$, $F_{y1}$) and ($F_{c1}$, $F_{m1}$, $F_{y4}=F_{y1}+\Delta F_{y4}$) in another three combination measured fields 2, 3 and 4. Consequently, the nominal degree of surface coverage of exactly one fundamental color is varied in each of the combination measured fields 2, 3 and 4 relative to the combination measured field 1, i.e., the degree of surface coverage of cyan is varied by $\Delta F_{c2}$ in combination measured field 2, that of magenta is varied by $\Delta F_{m3}$ in combination measured field 3, and that of yellow is varied by $\Delta F_{y4}$ in combination measured field 4. $\Delta F_{m3}$ and $\Delta F_{y4}$ may have both positive and negative values (signs).

Six single-color fields are printed with half tones, namely, fields 8 and 11 are printed in cyan at the nominal degrees of surface coverage of $F_{c1}$ and $F_{c2}$, fields 9 and 12 in magenta at the nominal degrees of surface coverage of $F_{m1}$ and $F_{m3}$, and fields 10 and 13 in yellow at the nominal degrees of surface coverage of $F_{y1}$ and $F_{y4}$.

Of the measured fields described, the printed product 50 to be checked in the edition contains at least the combination measured field 1, in which the fundamental colors cyan, magenta and yellow are superprinted at the nominal degrees of surface coverage ($F_{c1}$, $F_{m1}$, $F_{y1}$). An image area with identical image structure can also be used, in principle, as a combination measured field.

The primary print 40 is printed especially in relation to the ink material, the ink layer thickness and the increase in tonality, i.e., the increase in the degree of surface coverage from the film original or the printing plate to the print under standardized conditions. These conditions were specified for the editions by, e.g., UGRA in Switzerland or FOGRA in Germany. Whether the process according to the present invention is used in newspaper offset or in jobbing rotary offset is irrelevant for the principle of the mode of operation. The only thing that is essential is the requirement that the primary print 40 be prepared according to the same standard as the edition, i.e., the printed product to be checked and optimized.

Another condition is to be met in preparing the primary print 40 as well. Besides the measured field blocks, the primary print must also have additional surfaces printed with all fundamental colors in order to guarantee sufficient ink take-off at the site of the measured field block in the direction of movement of the paper. The layout of these surfaces is freely selectable. Analogous considerations apply to the ink take-off for the printed product 50 as well.

Using the primary print 40, the relationship between variations in the half-tone densities of cyan, magenta and yellow and the appearance of the combination measured field 1 as regards color can now be quantitatively determined.

In determining the dependence of the appearance of the combination measured field 1 as regards color on the half-tone densities of the fundamental colors, a transformation function L is determined, which converts a variation in the half-tone densities into the variation of the color location of the combination measured field, which variation of the color location results from that variation in the half tone densities.

The transformation function L is nonlinear in the general case. Since it is usually necessary to have to deal with relatively small variations around a standardized operating point in printing practice, it is permissible to linearize the relationships. In the interest of clarity, the process according to the present invention will be explained below on the basis of a linearized model. This is does not affect the desirability of generalizing formulations for linear and nonlinear systems.

The transformation function can be determined, e.g., as follows:

A colorimetric system of coordinates, preferably XYZ, is specified for the colorimetric measurements. CIELAB and CIELUV are also possible, in principle. It is important to always use the same system to indicate all colorimetric measured values. The explanations below are based on the example of standard XYZ color values for the sake of The XYZ standard color values are measured on the combination measured fields 1 through 4 of primary print 40. Four color location vectors $$\underline{R}=\begin{bmatrix} X \\ Y \\ Z \end{bmatrix}$$

are obtained, namely, $\underline{R}_1$ for measured field 1, $\underline{R}_2$ for measured field 2, $\underline{R}_3$ or measured field 3, and $\underline{R}_4$ for measured field 4.

Color densities are measured on the single-color fields 8 through 13 of primary print 40. Six half-tone density values are thus obtained, namely, $D_{c1}$ or measured field 8, $D_{c2}$ for measured field 11, $D_{m1}$ for measured field 9, $D_{m3}$ for measured field 12, $D_{y1}$ for measured field 10, and $D_{y4}$ for measured field 13.

With the definitions $$\underline{\underline{\Delta R_D}} = [\underline{R_2} - \underline{R_1}\ \underline{R_3} - \underline{R_1}\ \underline{R_4} - \underline{R_1}] \text{ and}$$

$$\underline{\underline{\Delta D}} = \begin{bmatrix} D_{c2} - D_{c1} & 0 & 0 \\ 0 & D_{m3} - D_{m1} & 0 \\ 0 & 0 & D_{y4} - D_{y1} \end{bmatrix}$$

it is possible to describe the linearized relationships between the measured variables by the following equation:

$$\underline{\Delta R_D} = \underline{\underline{L}}\,\underline{\Delta D}.$$

Here the 3×3 matrix $\underline{\underline{L}}$ stands for the transformation function L sought. To arrive at the transformation function, we must consequently solve the first equation only for $\underline{\underline{L}}$:

$$\underline{\underline{L}} = \underline{\Delta R_D}\,\underline{\Delta D}^{-1}.$$

By evaluating the primary print 40, we have thus determined both the quantitative relationship between variations in the half-tone density of the fundamental colors, and variations in the color location vector in the combination measured field 1.

The matrix $\underline{\underline{L}}$ is calculated on the basis of the matrices $\underline{\underline{LR_D}}$ and $\underline{\underline{\Delta D}}$ according to the process just described. $\underline{\Delta D_D}$ and $\underline{\underline{\Delta D}}$ are defined by measured values, which originate from the primary print 40 alone. This means that the matrix $\underline{\underline{L}}$ can be completely determined on the basis of a single primary print.

The transformation function obtained for the primary print can now be profitably used if the quality of edition prints is to be monitored. The prerequisite for this is that the combination measured field 1 be printed in the printed product 50 at the same nominal degrees of surface coverage for cyan, magenta and yellow as in the primary print 40.

The color location vector $\underline{R_{11}}$ in the combination measured field 1 is measured by measurement with a colorimeter on randomly selected copies of the printed product 50. The color location deviation $\underline{\Delta R_{11}}-\underline{R_D}$ is subsequently calculated by relating to a predetermined desired color location vector $\underline{R_O}$. The desired color location vector may be either a measured value originating from a given original or it may originate directly from the digital preliminary stage of printing.

By reversing the transformation function L, the variations $$\underline{\Delta D_{11}} = \begin{bmatrix} \Delta D_{c11} \\ \Delta D_{m11} \\ \Delta D_{y11} \end{bmatrix}$$

in the half-tone density of the fundamental colors cyan, magenta and yellow on the printed product 50, which are linked with the color location deviation $\underline{\Delta R_{11}}$, can be calculated:

$$\underline{\Delta D_{11}} = \underline{\underline{L}}^{-1}\,\underline{\Delta R_{11}}.$$

It was shown with the application of the process according to the present invention just described that variations in ink guiding on the printed product 50 in the three hue fundamental colors can be determined by a single colorimetric measurement. Information can thus be obtained on both the behavior of the individual colors and their interaction in a highly efficient manner. The expense necessary for this is reduced in two respects compared with prior-art processes:

- Fewer measured fields are necessary on the printed product, i.e., one combination measured field in cyan, magenta and yellow, instead of three single-color half-tone fields and three half-tone fields in two-color superprinting.
- The number of measurements to be performed on the printed product decreases from at least six to one.

Another advantage of the process is the fact that a quantitative criterion, which provides the customer of the printing shop directly with information on how the average human observer perceives the appearance of the printed product as regards color, is checked by the colorimetric measurement on the combination measured field 1 of the printed product 50.

The process according to the present invention makes it possible to use an image area with a suitable image structure instead of the combination measured field 1 on the printed product 50. The space required for the combination measured field 1 on the printed product can be saved as a result.

Another meaningful application of the process according to the present invention is that the complete measured field block of the primary print 40 is jointly printed in the printed product 50, so that the primary print proper can be omitted, and the primary print can be replaced with a primary copy of the printed product that was found to be good. It is possible to use, e.g., the first good copy of the edition instead of the primary print 40 to determine the transformation function L without any problem.

It may happen under these circumstances that there is too little space on the printed product to jointly print each of the primary fields 2, 3, 4, 8, 9, 10, 11, 12 and 13. Yet, the process according to the present invention can be used in such a case if a plurality of additional primary copies are printed in addition to a first primary print, while maintaining the following conditions:

- All primary prints contain at least the combination measured field 1 and the single-color measured fields 8, 9 and 10.
- The primary prints are prepared with varying ink layer thicknesses in all fundamental colors, so that the mean values of the ink layer thicknesses over the primary copies still always correspond to the print standard with sufficient accuracy.

It is now possible to determine the transformation L on the basis of a comparison of the variations in the color location vector $\underline{R1}$ in the combination measured field 1 and the variations in the density values $D_{c1}$, $D_{m1}$, $D_{y1}$ in the single-color measured fields 8, 9, 10. As before, the equation $$\underline{\Delta R_D} = \underline{L}\,\underline{\Delta D}$$

is used to determine the matrix $\underline{\underline{L}}$, and the matrices $\underline{\underline{\Delta R_D}}$ and $\underline{\Delta D}$ contain as terms differential amounts, which are formed due to differences in the ink layer thicknesses between the individual primary prints rather than due to different nominal degrees of surface coverage of the measured fields. If a larger number of primary prints are evaluated for the determination of the matrix $\underline{\underline{L}}$ than is necessary for a mathematically definite solution, the redundant system of equations resulting here-from can be solved according to the methods of balancing and regression calculation.

The type of the measuring instrument with which the measured data are obtained is irrelevant for the process according to the present invention. For example, it makes, in principle, no difference whether densitometric values are determined by means of a densitometer, a spectrophotometer, a video camera or any other suitable device. Analogously, colorimetric measurements may be performed with spectrophotometers, three-range colorimeters, video cameras or other suitable devices, without prejudice to the present invention. The type of the auxiliary means with which the further processing of the measured data is performed is also irrelevant.

The process according to the present invention can also be expanded in the direction of a four-color superprinting by also allowing a portion of the printing ink black in the combination measured fields on the primary print 40 and on the printed product 50. The only condition is that the nominal degree of surface coverage of black be the same on all four combination measured fields.

Due to the savings brought about by the process described in terms of the necessary measured fields and of the expense of the measurement, it now becomes possible in rotary offset, but especially in the offset printing of newspaper editions, for the first time ever, to systematically and routinely collect quality data on the printed product.

The printing plant can now obtain representative data on the quality level maintained by its production by specific statistical surveys at a reasonable expense. In printing presses operating on the basis of color zones, it is not necessary at all to jointly print and measure a separate combination measured field on the printed product for each color zone to be printed. A few areas with measured fields are sufficient for a production.

Furthermore, it becomes possible to recognize disturbances in the printing process, e.g., suddenly occurring changes in material properties, sooner and to take corrective measures.

The possibility of quantitatively documenting the print quality produced for the customer of a printing plant gives the printing plant a competitive edge over competitors who do not have this possibility. This aspect will gain added significance in the future, because a strong trend to certify the quality assurance system of printing plants according to the ISO 9000 standard is presently recognizable.

While a specific embodiment of the invention has been shown and described in detail to illustrate the application of the principles of the invention, it will be understood that the invention may be embodied otherwise without departing from such principles.

What is claimed is:

1. A group of measured fields for determining color data of a printed product, especially for collecting quality data in the rotary offset printing of single editions, with a plurality of measured fields, which are printed on a printed product to be checked or on a primary print in such a way that they can be optically scanned, the group of measured fields comprising:

a) a superprinted, at their nominal degrees of surface coverage ($F_{c1}$, $F_{m1}$, $F_{y1}$), first combination measured field, including the primary colors, especially the three colors cyan, magenta and yellow;

b) printed additional single-color half-tone fields, in the primary colors, wherein the single-color half-tone fields have, in their corresponding primary color, a degree of surface coverage ($F_{c1}$, $F_{m1}$, $F_{y1}$) that corresponds to that of the same color in the first combination measured field;

c) the measured field group contains additional combination measured fields, in which the primary colors are superprinted at varied nominal degrees of surface coverage ($F_{c2}=F_{c1}+\Delta F_{c2}$, $F_{m1}$, $F_{y1}$), ($F_{c1}$, $F_{m3}=F_{m1}+\Delta F_{m3}$, $F_{y1}$) and ($F_{c1}$, $F_{m1}$, $F_{y4}=F_{y1}+\Delta F_{y4}$) wherein each primary color is varied at least once, and at least one other primary color is varied in each additional combination measured field; and d) the group of measured fields has additional single-color half-tone fields provided in said primary colors including first single-color half-tone fields with said degree of surface coverage ($F_{c1}$, $F_{m1}$, $F_{y1}$) in their respective primary color and second single-color half-tone fields, in which the primary colors have a degree of surface coverage of ($F_{c2}$, $F_{m3}$, $F_{y4}$), which corresponds to said varied degree of surface coverage of the same color in the additional combination measured fields.

2. A measuring field group for detecting color data on a printed product, for the determination of quality data in the offset printing of single editions, said measuring field group comprising:

a plurality of measuring fields, which are printed in a manner to be optically scannable on a printed product to be checked or on a calibration print, wherein these measuring fields include:

a first combination measuring field, in which each of a first primary color, a second primary color and a third primary color, are printed over each other, each with a nominal degree of surface coverage;

additional combination measuring fields with a first additional combination measuring field in which the primary colors are printed over each other, with said first primary color and said second primary color printed at said nominal degree of surface coverage and with said third primary color printed at a degree of surface coverage which is varied from said nominal degree of surface coverage:

a second additional combination measuring field in which the primary colors are printed over each other with said first primary color and said third primary color printed at said nominal degree of surface coverage and with said second primary color printed at a degree of surface coverage which is varied from said nominal degree of surface coverage;

a third additional combination measuring field in which the primary colors are printed over each other, with said second primary color and said third primary color printed at said nominal degree of surface coverage and with said first primary color printed at a degree of surface coverage which is varied from said nominal degree of surface coverage;

a first primary color individual color half-tone field having a degree of surface coverage that corresponds to said nominal degree of surface coverage of said first primary color, in said first combination field;

a second primary color individual color half-tone field having a degree of surface coverage that corresponds to said nominal degree of surface coverage of said second primary color, in said first combination field; and a third primary color individual color half-tone field having a degree of surface coverage that corresponds to said nominal degree of surface coverage of said third primary color, in said first combination field.

3. A measuring field group in accordance with claim 2, wherein:

said additional combination measuring fields further comprise:

a first primary color additional half-tone field having a degree of surface coverage which corresponds to said varied degree of surface coverage of said first primary color in said third additional combination measuring field;

a second primary color additional half-tone field having a degree of surface coverage which corresponds to said varied degree of surface coverage of said second primary color in said second additional combination measuring field; and a third primary color additional half-tone field having a degree of surface coverage which corresponds to said varied degree of surface coverage of said third primary color in said first additional combination measuring field.

4. A measuring field group for detecting color data on a printed product, for the determination of quality data in the offset printing of single editions, said measuring field group comprising:

a plurality of measuring fields, which are printed in a manner to be optically scannable on a printed product to be checked or on a calibration print, wherein these measuring fields include:

a first combination measuring field, in which the primary colors cyan, magenta and yellow are printed over each other, each with a nominal degree of surface coverage, and a first additional combination measuring field in which the primary colors cyan, magenta and yellow are printed over each other, with cyan and magenta printed at said nominal degree of surface coverage and with yellow printed at a degree of surface coverage which is varied from said nominal degree of surface coverage;

a second additional combination measuring field in which the primary colors cyan, magenta and yellow are printed over each other, with cyan and yellow printed at said nominal degree of surface coverage and with magenta printed at a degree of surface coverage which is varied from said nominal degree of surface coverage;

a third additional combination measuring field in which the primary colors cyan, magenta and yellow are printed over each other, with magenta and yellow printed at said nominal degree of surface coverage and with cyan printed at a degree of surface coverage which is varied from said nominal degree of surface coverage;

a cyan individual color half-tone field having a degree of surface coverage that corresponds to said nominal degree of surface coverage of cyan in said first combination field;

a magenta individual color half-tone field having a degree of surface coverage that corresponds to said nominal degree of surface coverage of magenta in said first combination field; and a yellow individual color half-tone field having a degree of surface coverage that corresponds to said nominal degree of surface coverage of yellow in said first combination field:

a cyan additional half-tone field having a degree of surface coverage which corresponds to said varied degree of surface coverage of cyan in said third additional combination measuring field:

a magenta additional half-tone field having a degree of surface coverage which corresponds to said varied degree of surface coverage of magenta in said second additional combination measuring field; and a yellow additional half-tone field having a degree of surface coverage which corresponds to said varied degree of surface coverage of yellow in said first additional combination measuring field.

* * * * *